US009038965B2

(12) United States Patent
Gruber et al.

(10) Patent No.: US 9,038,965 B2
(45) Date of Patent: May 26, 2015

(54) METHOD AND SEQUENTIAL MONITORING OVERLAY SYSTEM FOR TRACK CIRCUITS

(71) Applicant: Ansaldo STS USA, Inc., Pittsburgh, PA (US)

(72) Inventors: Mark John Gruber, Pittsburgh, PA (US); Michael James Beacham, Pittsburgh, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 118 days.

(21) Appl. No.: 13/799,902

(22) Filed: Mar. 13, 2013

(65) Prior Publication Data

US 2013/0240679 A1 Sep. 19, 2013

Related U.S. Application Data

(60) Provisional application No. 61/612,495, filed on Mar. 19, 2012.

(51) Int. Cl.

| | |
|---|---|
| ***B61L 5/00*** | (2006.01) |
| ***B61L 27/04*** | (2006.01) |
| ***B61L 27/00*** | (2006.01) |
| *B61L 1/18* | (2006.01) |
| *B61L 3/22* | (2006.01) |

(52) U.S. Cl.

CPC .. *B61L 27/04* (2013.01); *B61L 1/18* (2013.01); *B61L 3/221* (2013.01); *B61L 27/0088* (2013.01)

(58) Field of Classification Search

USPC ..... 246/2 R, 3, 14, 20, 27, 28, 131–135, 162

See application file for complete search history.

(56) References Cited

U.S. PATENT DOCUMENTS 3,963,201 A 6/1976 Brumberger et al.
3,979,092 A * 9/1976 Perry et al. ..... 246/34 R (Continued)

FOREIGN PATENT DOCUMENTS

GB 2 367 410 A 4/2002

OTHER PUBLICATIONS

Fazio, V. et al., "Impact of Signalling and Automation Failure Modes on Railway Operation: Assessment by Simulation", http://www.uic.org/cdrom/2001/wcrr2001/pdf/sp/3_7_1/067.pdf, 2001, 8 pp.

(Continued)

*Primary Examiner* — R. J. McCarry, Jr.

(74) *Attorney, Agent, or Firm* — Eckert Seamans Cherin & Mellott, LLC; Philip E. Levy

(57) ABSTRACT

A sequential monitoring system is for an interlocking logic system and a track circuit system including a plurality of track circuits. The sequential monitoring system includes an interface between the interlocking logic system and the track circuit system; and a processor structured to monitor a state of each of the track circuits, validate a sequence of state changes of the track circuits, and interrupt and correct invalid track circuit state indications between the track circuit system and the interlocking logic system. The interface normally passes inputs from the track circuit system to outputs to the interlocking logic system. When an out of sequence event occurs, the processor applies a quarantine to a minimum of three of the track circuits in a quarantined area, thereby inhibiting use of an unoccupied track circuit in the quarantined area.

20 Claims, 10 Drawing Sheets

(56) References Cited

U.S. PATENT DOCUMENTS

| | | | |
|---|---|---|---|
| 4,619,425 | A | 10/1986 | Nagel |
| 5,330,135 | A | 7/1994 | Roberts |
| 7,050,890 | B2 | 5/2006 | Tolmei |

OTHER PUBLICATIONS

Lutovac, D. et al., "Towards an Universal Computer Interlocking System", Series: Electronics and Energetics, vol. 11, No. 1, http://citeseerx.ist.psu.edu/viewdoc/download?doi=10.1.1.98.3764&rep=rep1&type=pdf, 1998, pp. 25-49.

Network Rail Limited, "Network Rail Oct. 2007 Strategic Business Plan", http://www.networkrail.co.uk/browse%20documents/, StrategicBusinessPlan/Other%20supporting%20documents/Asset%20Policies%20301007. pdf#page=294, 2007, pp. 1, 147 and 170.

Rao, P. et al., "Microprocessor-Based Railway Interlocking Control With Low Accident Probability", (Abstract) vol. 36, Issue 3, http://ieeexplore.ieee.org/xpl/freeabs_all.jsp?arnumber=1623505, Aug. 1987, 1 p.

* cited by examiner

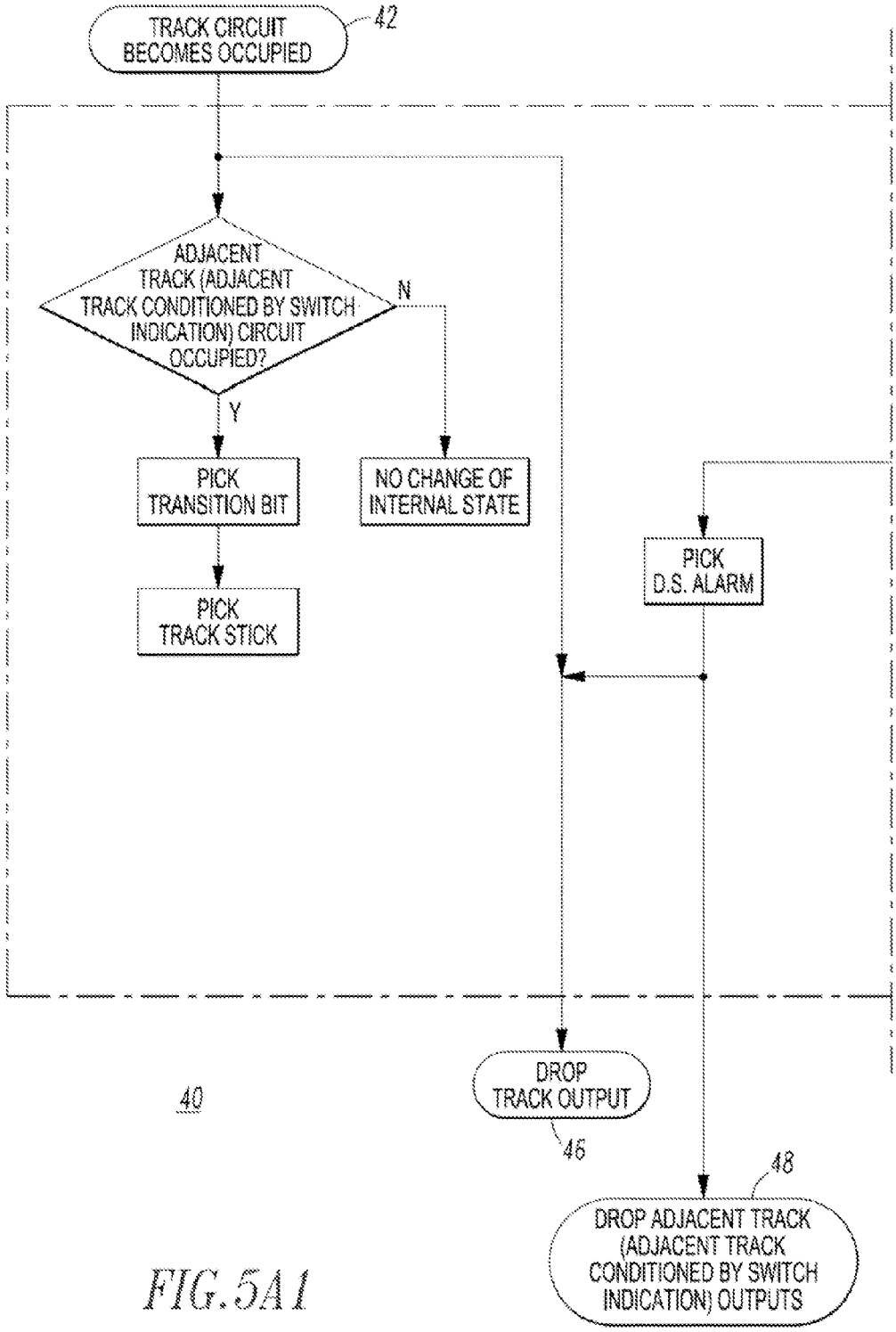
FIG. 5A1

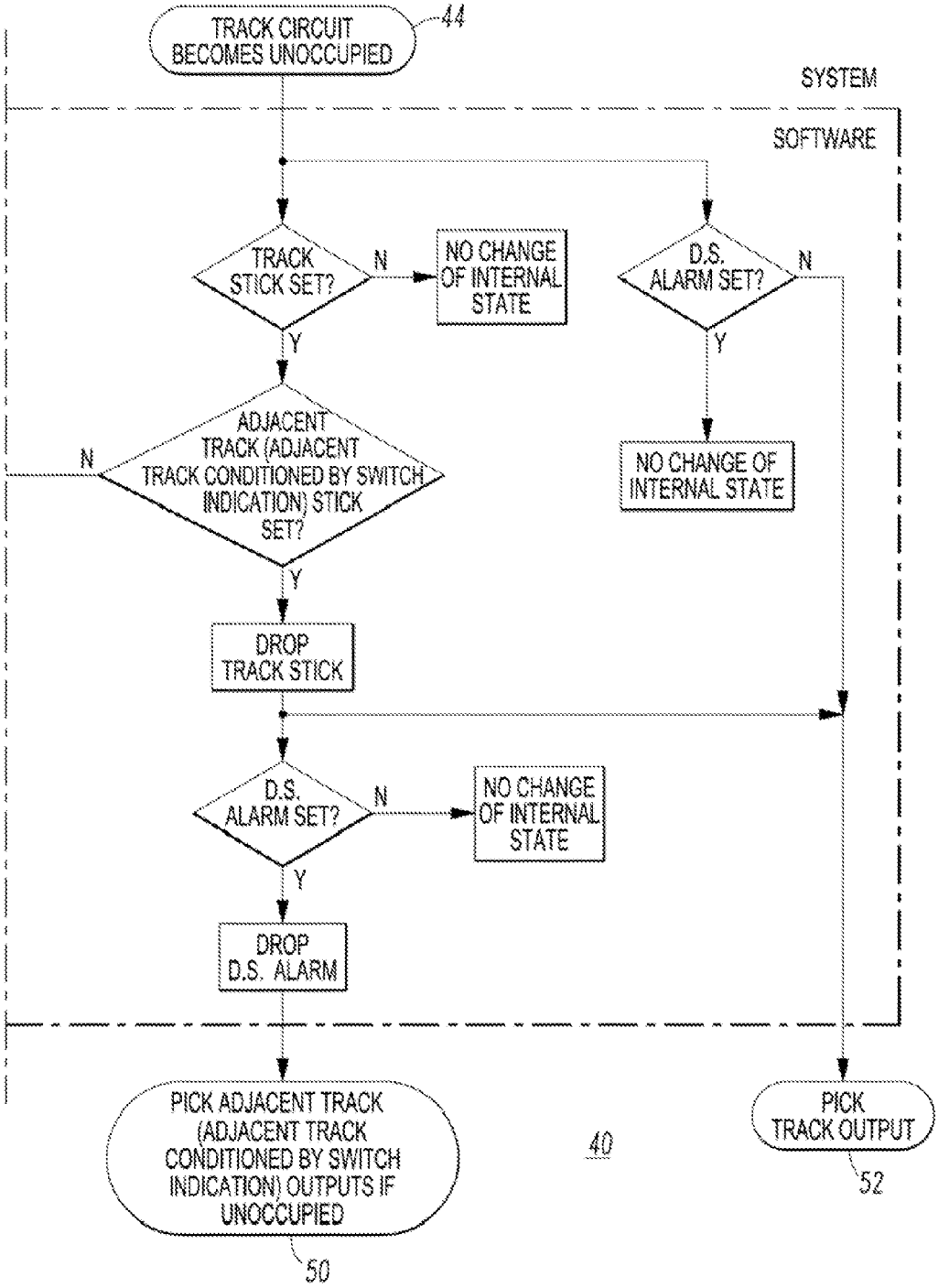
FIG.5A2

METHOD AND SEQUENTIAL MONITORING OVERLAY SYSTEM FOR TRACK CIRCUITS

CROSS-REFERENCE TO RELATED APPLICATION

This application claims the benefit of U.S. Provisional Patent Application Ser. No. 61/612,495, filed Mar. 19, 2012, which is incorporated by reference herein.

BACKGROUND

1. Field

The disclosed concept pertains generally to systems for track circuits and, more particularly, to interlocking systems. The disclosed concept further pertains to overlay systems for such interlocking systems. The disclosed concept also pertains to methods for monitoring track circuits.

2. Background Information

In the art of railway signaling, traffic flow through signaled territory is typically directed by various signal aspects appearing on wayside indicators or cab signal units located on board railway vehicles. The vehicle operators recognize each such aspect as indicating a particular operating condition allowed at that time. Typical practice is for the aspects to indicate prevailing speed conditions.

For operation of this signaling scheme, the track is typically divided into cascaded sections known as "blocks." These blocks can be electrically isolated from adjacent blocks by typically utilizing interposing insulated joints. In many audio frequency (AF) track circuits, continuous welded rail is used, and the blocks are delimited by tuned bonds. When a block is unoccupied, track circuit apparatus connected at each end are able to transmit signals through the rails within the block. Such signals may be coded to contain control data enhancing the signaling operation. Track circuits operating in this manner are referred to as "coded track circuits." One such coded track circuit is illustrated in U.S. Pat. No. 4,619,425. When a block is occupied by a railway vehicle, shunt paths are created across the rails by the vehicle wheel and axle sets. While this interrupts the flow of information between respective ends of the block, the presence of the vehicle can be positively detected. Similarly, non-coded track circuits detect the presence of a railway vehicle via shunt paths.

In a track layout having a number of switch turnouts and rail crossings, it is necessary to assure a clear route, unobstructed by any other railway vehicles, for an entering train in order to fully exploit the train's speed capabilities. The concept of railroad interlocking, developed as early as 1857, provides this clear route assurance by preventing other vehicles from taking routes conflicting with that of the entering train.

Common interlocking systems make use of products and systems to detect occupancy (by railway vehicle(s)) of sections of track known as track circuits and employ relay or microprocessor-based logic to select the maximum speed that a railway vehicle can safely travel in a given area. With these systems, occupancy of track circuits plays an important role in the logical selection of the appropriate wayside signal aspect, wayside train-stopping device position, or onboard cab-signal aspect.

While track circuits used to detect the presence of trains on sections of rail are designed to fail in a safe manner, certain non-safe failure modes might occur, and certain conditions may exist that prevent positive detection of occupancy. Since current train control systems rely on the information provided by the track circuits to properly control the maximum speed of following trains, the integrity of this information is paramount. A wrong-side failure or a failure of track circuit resulting in an unsafe (or undetected vehicle) condition may be unlikely, but is still possible. A wrong-side failure occurs when a system, product, or component fails in an unsafe manner, or in a manner associated with a hazardous condition.

As authorities seek to maximize the safety of train passengers, it is desired to better monitor the track circuit train detection system to prevent unsafe conditions resulting from, for example, wrong-side failures of track circuits.

There is room for improvement in systems for track circuits and interlocking systems.

There is also room for improvement in methods of monitoring track circuits.

SUMMARY

These needs and others are met by embodiments of the disclosed concept which validate a sequence of state changes of track circuits, interrupt and correct invalid track circuit state indications between a track circuit system and an interlocking logic system; and apply a quarantine to a minimum of three of the track circuits in a quarantined area when an out of sequence event occurs, thereby inhibiting use of an unoccupied track circuit in the quarantined area.

As one aspect of the disclosed concept, a method of sequentially monitoring a plurality of track circuits is for an interlocking logic system and a track circuit system including the track circuits, each of the track circuits having a state. The method comprises: interfacing between the interlocking logic system and the track circuit system; normally passing inputs from the track circuit system to outputs to the interlocking logic system; monitoring the state of each of the track circuits by a processor; validating a sequence of state changes of the track circuits by the processor; interrupting and correcting invalid track circuit state indications by the processor between the track circuit system and the interlocking logic system; and applying a quarantine by the processor to a minimum of three of the track circuits in a quarantined area when an out of sequence event occurs, thereby inhibiting use of an unoccupied track circuit in the quarantined area.

As another aspect of the disclosed concept, a sequential monitoring system is for an interlocking logic system and a track circuit system including a plurality of track circuits, each of the track circuits having a state. The sequential monitoring system comprises: an interface between the interlocking logic system and the track circuit system; and a processor structured to monitor the state of each of the track circuits, validate a sequence of state changes of the track circuits, and interrupt and correct invalid track circuit state indications between the track circuit system and the interlocking logic system, wherein the interface normally passes inputs from the track circuit system to outputs to the interlocking logic system, and wherein when an out of sequence event occurs the processor applies a quarantine to a minimum of three of the track circuits in a quarantined area, thereby inhibiting use of an unoccupied track circuit in the quarantined area.

As another aspect of the disclosed concept, a sequential monitoring overlay system is for an interlocking logic system and a track circuit system including a plurality of track circuits, each of the track circuits having a state. The sequential monitoring overlay system comprises: an overlay interface between the interlocking logic system and the track circuit system; and a processor structured to monitor the state of each of the track circuits, validate a sequence of state changes of the track circuits, and interrupt and correct invalid track circuit state indications between the track circuit system and the interlocking logic system, wherein the interface normally passes inputs from the track circuit system to outputs to the interlocking logic system, and wherein when an out of sequence event occurs the processor applies a quarantine to a minimum of three of the track circuits in a quarantined area, thereby inhibiting use of an unoccupied track circuit in the quarantined area.

BRIEF DESCRIPTION OF THE DRAWINGS

A full understanding of the disclosed concept can be gained from the following description of the preferred embodiments when read in conjunction with the accompanying drawings in which:

FIGS. 5A1-5A2, 5B, 5C, 5D, 5E and 5F are flowcharts of logic for the SMO processor system of FIG. 3 including logic for the sequential monitoring overlay system, logic for adjacent track determination, logic for track shunt to track stick, logic for track release to track stick release and disrupted sequence alarm release, logic for alarm to quarantine, and logic for output, respectively.

DESCRIPTION OF THE PREFERRED EMBODIMENTS

Figure 1:
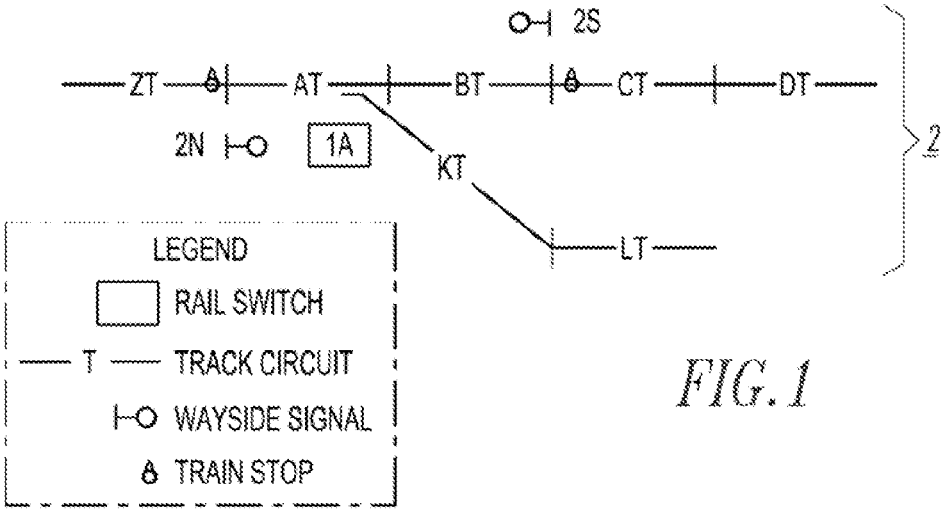
FIG. 1 is a single line diagram in schematic form of a group of track circuits.

As employed herein, the term "number" shall mean one or an integer greater than one (i.e., a plurality).

As employed herein, the term "processor" shall mean a programmable analog and/or digital device that can store, retrieve, and process data; a computer; a workstation; a personal computer; a vital processor; a microprocessor; a microcontroller; a microcomputer; a central processing unit; a mainframe computer; a mini-computer; a server; a networked processor; or any suitable processing device or apparatus.

As employed herein, the term "vital" or "vitally" means that the acceptable probability of a hazardous event resulting from an abnormal outcome associated with a corresponding activity or thing is less than about $10^{-9}$/hour. Alternatively, the mean time between hazardous events is greater than $10^{9}$ hours. Static data used by vital routines (or logic), including, for example, track data, have been validated by a suitably rigorous process under the supervision of suitably responsible parties.

As employed herein, the term "right-side failure" means a failure of a system, product, or component resulting in a non-hazardous condition.

As employed herein, the term "wrong-side failure" means a failure of a system, product, or component resulting in a hazardous condition.

As employed herein, the term "track circuit becomes occupied" shall mean a state where the rails between the track circuit boundaries become occupied by a vehicle. This state is determined by a suitable track circuit product and is provided to a vital processor by the track circuit product.

As employed herein, the term "track circuit becomes unoccupied" shall mean a state where the rails between the track circuit boundaries become unoccupied by any vehicle. This state is determined by the track circuit product and is provided to the vital processor by the track circuit product.

As employed herein, the term "adjacent track" shall mean a section of track immediately bordering the track circuit in question.

As employed herein, the term "track stick" shall mean a state within the vital processor that is determined by logic that is logical one only when the track circuit has become occupied in proper sequence or when latched. This state is latched and can only be released if the track circuit becomes unoccupied and one or both of the adjacent track sticks are set.

As employed herein, the term "D.S. alarm" or "disrupted sequence alarm" shall mean a state within the vital processor that is determined by logic that is logical one only when the track circuit becomes unoccupied without the proper sequence or when latched. This state is latched and can only be released with both proper transitions into and out of the track circuit in the center of the D.S. alarm.

As employed herein, the term "track occupancy" or "track occupied" shall mean states where the rails between the track circuit boundaries are occupied by one or more vehicles. These states are determined by track circuit products and are provided to the vital processor by the track circuit products.

As employed herein, the term "track unoccupied" shall mean states where the rails between the track circuit boundaries are unoccupied by any vehicle. These states are determined by the track circuit products and are provided to the vital processor by the track circuit products.

As employed herein, the term "B-C transition" shall mean a state within the vital processor that is determined by logic when both track circuits B and C are occupied, and latched with either track circuit occupied.

As employed herein, the term "A-B transition" shall mean a state within the vital processor that is determined by logic when both track circuits A and B are occupied, and latched with either track circuit occupied.

As employed herein, the term "'A' shares fixed boundary with 'B'" shall be determined manually by suitable analysis during design of a rail system. A fixed boundary is a physical point in space where the rails for track circuit A connect to the rails for track circuit B. It can be defined by insulated joints, connections to the rails, or equipment mounted to the rails.

As employed herein, the term "'A' shares switched boundary with 'B'" shall be determined manually by suitable analysis during design of a rail system. A switched boundary is a physical point in space where the rails for track circuit A connect to the rails for track circuit B only when movable rails (or a rail switch) are in a particular position.

As employed herein, the term "switch is positioned to share boundary between 'A' and 'B'" shall mean a state determined by switch monitoring equipment, which identifies the position of the movable rails as connecting 'A' to 'B'. This state is provided to the vital processor by the switch monitoring equipment.

As employed herein, the term "pick" shall mean an action within the vital processor where the state of a bit changes from logical zero to logical one.

As employed herein, the term "set" shall mean a state within the vital processor where the state of a bit is logical one.

As employed herein, the term "drop" shall mean an action within the vital processor where the state of a bit changes from logical one to logical zero.

As employed herein, the term "track output" shall mean a parallel output associated with the track circuit that is energized (logical one) when unoccupied without quarantine, and de-energized (logical zero) when occupied or under quarantine.

As employed herein, the term "output A" shall mean an output of a sequential monitoring overlay system. The output is in the "on" state when the corresponding track is not occupied and not in quarantine. The output is in the "off" state when the corresponding track circuit is occupied or in quarantine. The output is a physical parallel output where the electrical potential (voltage) between two points is changed based on the state of the output.

As employed herein, the term "adjacent track conditioned by switch indication" shall mean the adjacent track is dependent on a movable section of rail (or a rail switch) and only the adjacent track associated with the current position of the movable section of rail is considered.

As employed herein, the term "quarantine A, B or C" shall mean a state within the vital processor wherein the track circuit is quarantined. The track circuit is quarantined by forcing the state of track occupancy to track occupied.

As employed herein, the term "A, B or C track stick" shall mean a state within the vital processor that is determined by logic when the track stick bit corresponding to track circuit (A, B or C) is set.

As employed herein, the term "ABC D.S. alarm" shall mean a state within the vital processor that is determined by logic when the D.S. alarm bit centered around track circuit "B" becomes set. The logic that produces this (or releases this) alarm is discussed, below, in connection with FIG. 5D.

As employed herein, the term "proper release of B track circuit" shall mean the B track circuit "releases" when it becomes unoccupied with a proper sequence (i.e., with an adjacent track circuit occupied). The corresponding logic for this function is discussed, below, in connection with FIG. 5D.

As employed herein, the term "proper release of ABC D.S. alarm" shall mean the D.S. (disrupted sequence) alarm releases when the track occupancy inputs are sequenced properly through the area with the disrupted sequence alarm. The corresponding logic for this function is discussed, below, in connection with FIG. 5D.

The disclosed concept is described in association with an example interlocking system, although the disclosed concept is applicable to a wide range of interlocking systems for a wide range of track circuit detection systems.

The disclosed concept employs a vital processor system to monitor the state of each track circuit, validate the sequence of track circuit state changes, and interrupt and correct invalid track circuit state indications between the track circuit system and the interlocking logic system.

Sequential occupancy detection logic monitors the sequential occupancy of track circuits (see, for example and without limitation, an example track circuit layout 2 in FIG. 1), and initiates a quarantine when the sequence is disrupted. This is accomplished by monitoring of the transitions between track circuits with logic 4 when two adjacent track circuits are occupied simultaneously (a Track Transition, FIG. 2A). The proper sequence of track circuit and transition is monitored with logic 6 that sticks a valid entry into a track circuit (a Track Stick, FIG. 2B). These two functions are monitored for disruptions by logic 8 that is triggered with a disruption and stuck until the proper sequence is proven (a Disrupted Sequence Quarantine, FIG. 2C). The quarantine is used in each track circuit with logic 10 to inhibit the use of an unoccupied track circuit in a quarantined area (Loss of Sequence Repeater, FIG. 2D). Each part of this logic is discussed, below.

Figure 2A:
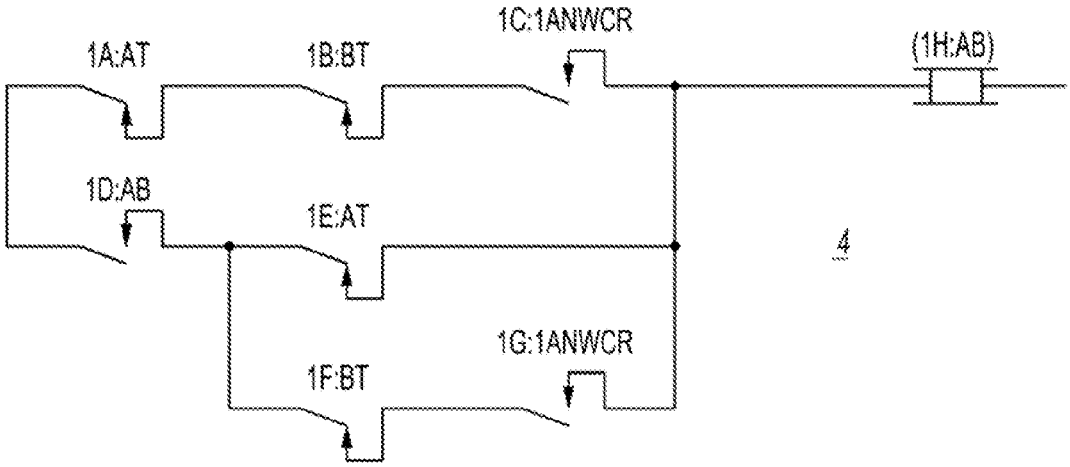
FIGS. 2A-2D are logic diagrams in schematic form of Track Transition, Track Stick, Disrupted Sequence Quarantine and Loss of Sequence Repeater logic.

Track Transition is shown in FIG. 2A. For the Pick Path, with a track circuit occupied (1A) and it's adjacent track circuit occupied (1B) (logic is written for "left to right" analysis of a track plan) and the steering switch in the proper position (1C), the transition bit (1H) sets. For the Stick Path, with the transition bit (1D) set and either the track circuit initially occupied (1E) still occupied, or the adjacent track circuit occupied (1F) given the steering switch in the proper position (1G), the logic 4 sticks. For the track transition bit (1H), set=on=proper transition, and clear=off=no proper transition (proper transitions are only necessary when the track circuit is occupied, it is normal for an unoccupied track to not have a proper transition, and thus no track transition bit is set.)

Figure 2B:
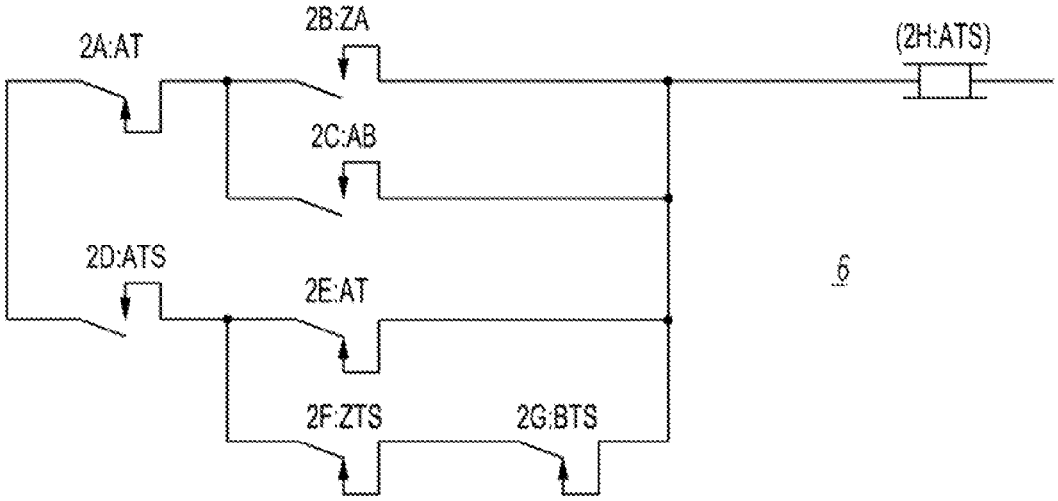

Track Stick is shown in FIG. 2B. For the Pick Path, with a track circuit occupied (2A) and the transition bit to one of the adjacent track circuits (2B,2C) set, the track stick bit (2H) sets. For the Stick Path, with the track stick bit (2D) set and either the track circuit initially occupied (2E) still occupied, or any immediately adjacent track circuit track stick (2F,2G) clear (the adjacent track is not occupied via a proper transition), the logic 6 sticks. For the track stick bit (2H), set=on=track occupied via a proper transition, and clear=off=track not occupied via a proper transition. Track Sticks are only necessary when the track circuit is occupied. It is normal for an unoccupied track to not have a track stick bit set.

Figure 2C:
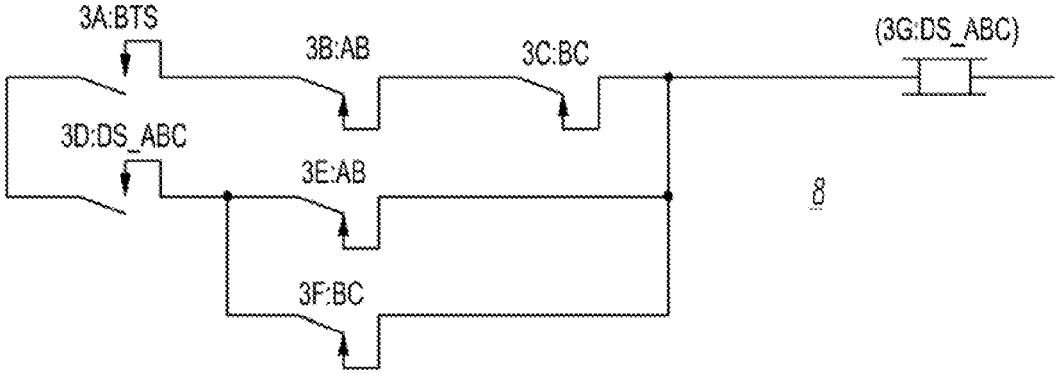

Disrupted Sequence Quarantine is shown in FIG. 2C. For the Pick Path, with a track circuit stick (3A) set (the track is occupied via a proper transition) and the transition bit to each adjacent track circuit (3B,3C) clear (no proper transition), the disrupted sequence quarantine bit (3G) sets. This state simply means that the track circuit was occupied without proper transition. For the Stick Path, with the disrupted sequence quarantine bit (3D) set and any transition bit to an adjacent track circuit (3E,3F) clear, the logic 8 sticks. This results in the disrupted sequence quarantine bit remaining stuck until both transition bits (into and out of the track circuit) are set simultaneously. For the disrupted sequence quarantine bit (3G), set=on=quarantined, clear=off=not quarantined. The quarantine applies to the track where the occupancy was last known, and each immediately adjacent track (as determined by switch steering).

Figure 2D:
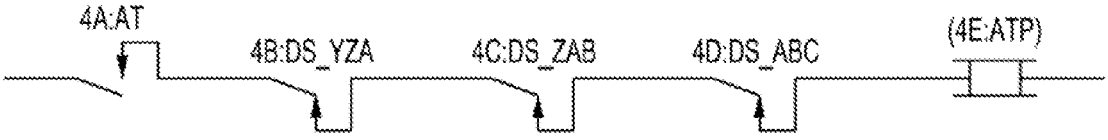

Loss of Sequence Repeater is shown in FIG. 2D. The track circuit loss of sequence repeater (4E) is set by the logic 10 only when the track circuit is unoccupied (4A) and any disrupted sequence quarantine affecting the track circuit (4B,4C, 4D) is clear. When the track circuit already has a repeater for loss of shunt time, the quarantines can be implemented in the loss of shunt repeater, thereby creating a loss of sequence or loss of shunt repeater.

Figure 3:
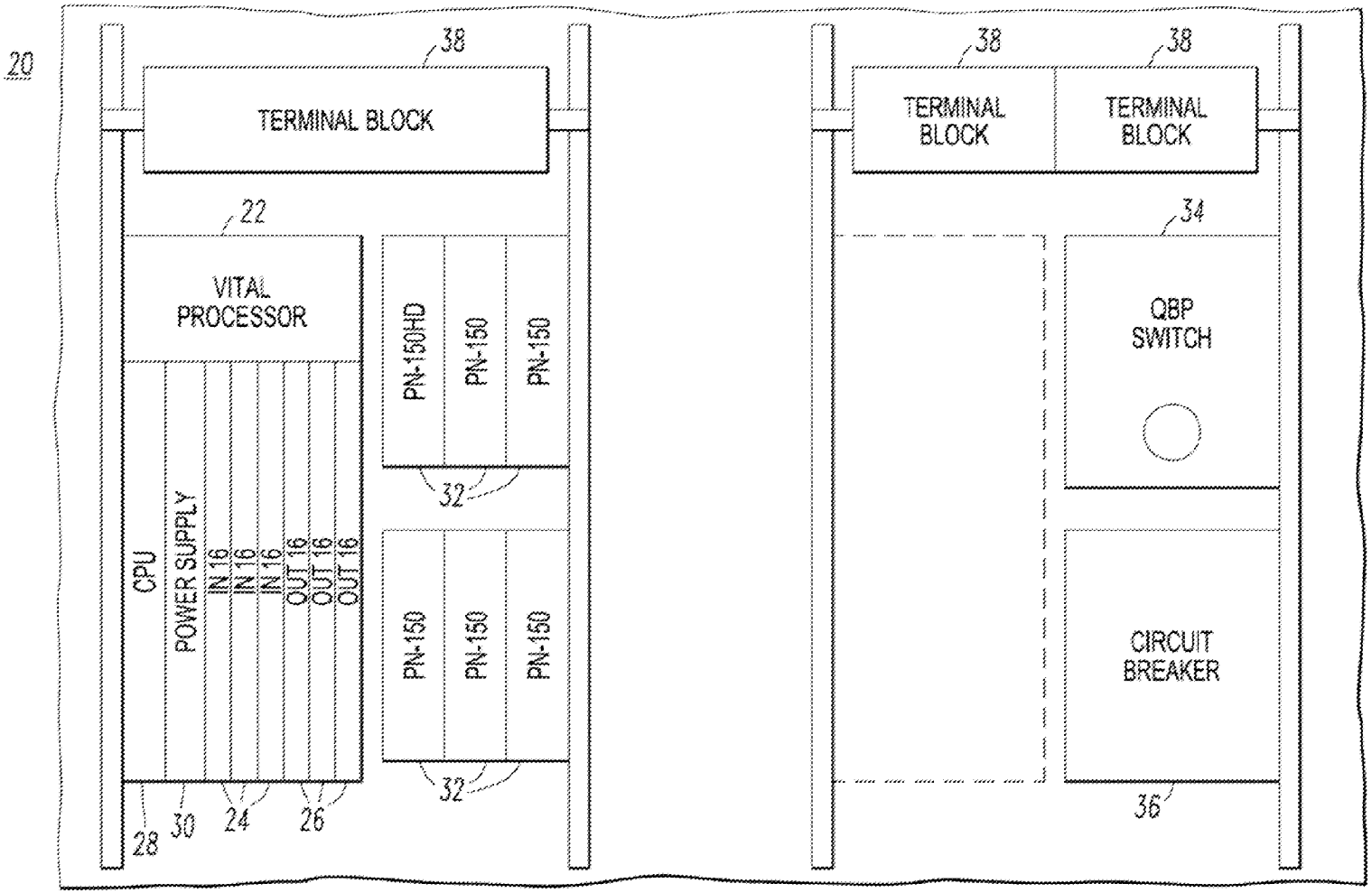
FIG. 3 is an equipment layout diagram in schematic form of a sequential monitoring overlay (SMO) processor system in accordance with embodiments of the disclosed concept.
Figure 4A:
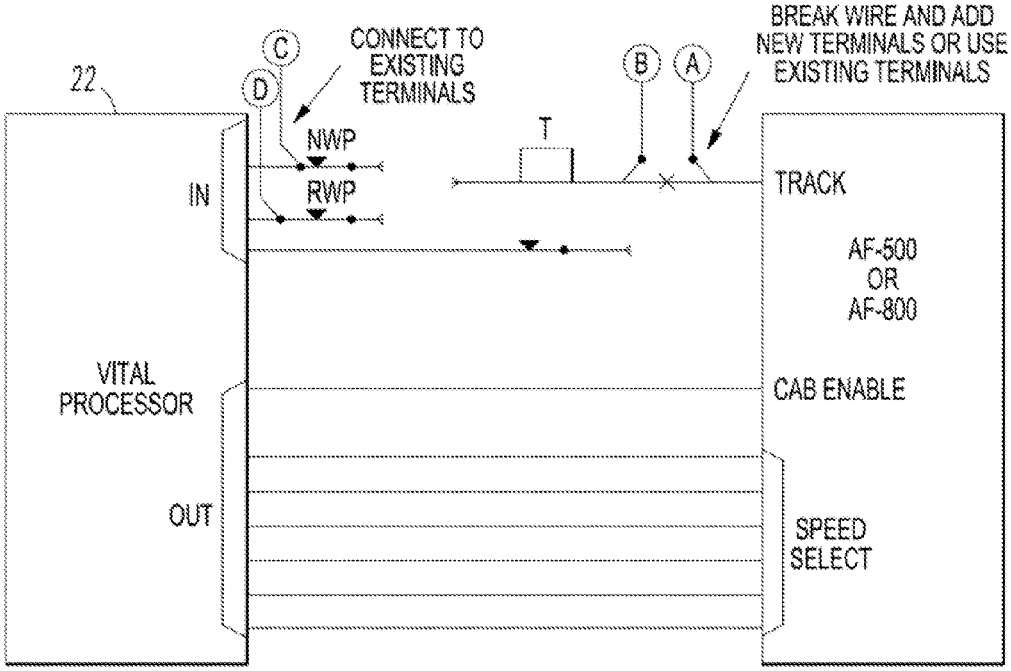
FIGS. 4A-4D are block diagrams in schematic form of interfaces of the SMO processor system of FIG. 3 to audio frequency track circuits and switch point indication circuits, power frequency track circuits and line circuits, various equipment interface points, and a set of form C contacts of a bypass switch, respectively.
Figure 4B:
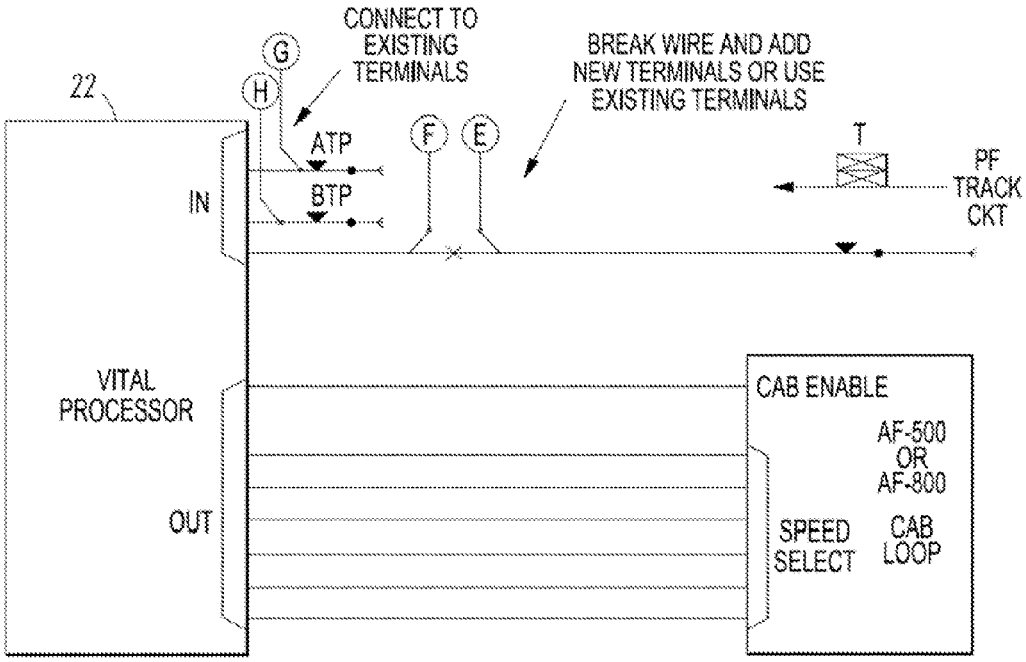
Figure 4C:
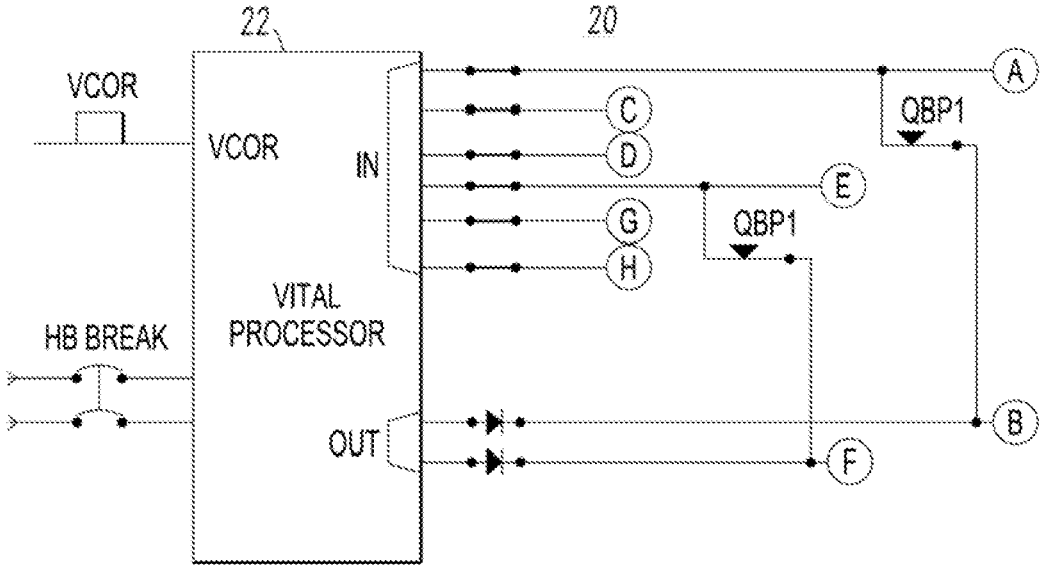

FIGS. 3 and 4C show a block diagram of a sequential monitoring overlay (SMO) processor system 20 that includes a vital processor 22 (e.g., without limitation, a MicroLok® II HB (half box) marketed by Ansaldo STS USA, Inc. of Pittsburgh, Pa.), populated with three MicroLok® II 16-channel vital input boards (IN16) 24, three MicroLok® II 16-channel vital output boards 26 (OUT16) (each of which provides 16 parallel outputs), one MicroLok® II CPU (central processing unit) board 28, and one MicroLok® II power supply (PS) board 30. The non-processor hardware includes vital relays 32 (e.g., without limitation, PN-150 marketed by Ansaldo STS USA, Inc. of Pittsburgh, Pa.), a key switch 34, a two-pole circuit breaker 36, and associated wiring and terminals 38.

The SMO processor interfaces with relay room wiring as shown in FIGS. 4A-4C. FIG. 4A shows interfaces to AF (audio frequency) track circuits (A and B) and interfaces to switch point indication circuits (C and D). RWP is a Reverse sWitch rePeater; this provides one of two possible switch positions for aligning a track to direct a train. NWP is a Normal sWitch rePeater; this provides one of two possible switch positions for aligning a track to direct a train.

FIG. 4B shows switch position interfaces to PF (power frequency) track circuits (E and F) and interfaces to line circuits (G and H). ATP is A (an arbitrary designation) Track rePeater; this is an indication of a train on the track circuit. BTP is B (an arbitrary designation) Track rePeater; this is an indication of a train on the track circuit.

Figure 4D:
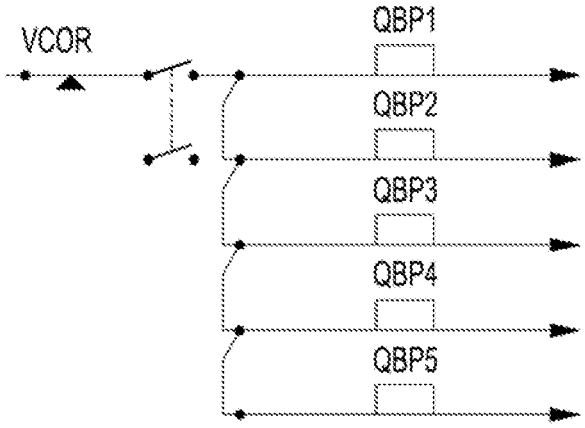

FIG. 4C shows how the various equipment interface points of FIGS. 4A, 4B and 4D interconnect with the SMO processor. A Vital Cut Off Relay (VCOR) is a standard part of many vital processors that employ a fail safe method of isolating the vital processor I/O from the rest of the system in the event of a failure of the vital processor.

The SMO processor also allows bypass of quarantined track circuits within the limits of control of the relay room with selection of a quarantine bypass (QBP) mode with the QBP switch 34 (FIG. 3). This results in an indication of QBP mode by an example single form C contact of the QBP bypass switch 34 as shown in FIG. 4D. QBP1 to QBP5 are repeaters (e.g., relays connected together in such a manner that each operate the same way) of the quarantine bypass switch 34. Repeaters are employed to ensure that there are sufficient contacts to bypass each track circuit indication in hardware. For example and without limitation, six contacts per relay and five relays allow 30 bypassed indications.

The SMO system 20 monitors all AF and PF track circuits by connecting to part of the circuit path that feeds the track information into the vital processor 22. The SMO system 20 passes through the track circuit occupancy status if: (a) the track circuit is not quarantined; or (b) the system is in bypass mode. The SMO system 20 interferes with the track circuit occupancy indication provided to the vital processor 22 by holding the indication of the track circuit occupancy status OFF when the track circuit under consideration is quarantined. The SMO system 20 determines whether a vehicle, such as an example train, could have validly occupied a track circuit by requiring that any track circuit adjacent to the track circuit in question be occupied in order to trigger a track circuit quarantine. This feature allows for momentary individual track circuit "bobbling" or "bobbing" (e.g., when the track circuit momentarily indicates track occupied while unoccupied) in unoccupied sections of track. The SMO system 20 applies a quarantine to a minimum of three track circuits when an out of sequence event occurs. This is due to the system uncertainty regarding the direction of the train, or the reason for a track circuit changing state from occupied to unoccupied without an adjacent track circuit indicating occupied (i.e., a train validly exiting the track circuit but not shunting the adjacent track circuit or a train losing shunt in the track circuit).

Because the SMO system 20 functions regardless of the direction of train movement, operation in normal or reverse traffic (with or without valid traffic or valid routes) does not cause false indications of out of sequence events.

For example and without limitation, the SMO system 20 can incorporate MicroLok® II executive and application logic. The application logic defines the bits used in the application, while the executive logic vitally monitors the state of all bits (including input, output and internal).

The SMO software, as will be described in FIGS. 5A1-5A2 and 5B-5F, uses various pieces of stored and immediate data to determine whether track circuits are occupied in a proper sequence. Immediate data available is the current state of all track circuits and switch points available to the system. Stored data consists of latched states (e.g., without limitation, latched transitions: two adjacent track circuits occupied simultaneously and latched with one occupied).

The SMO software quarantines three track circuits (A, B and C), the two adjacent track circuits (A and C) and the track circuit in question (B), with the out of sequence event. For a track section that is not in the quarantined state, the SMO software passes the track circuit inputs to their respective outputs. However, a quarantine causes the SMO system 20 to interfere with the pass through logic for the quarantined track circuits, thereby effectively forcing and maintaining the OFF state for these outputs.

As long as the vital processor 22 remains on, the SMO software maintains the quarantine until the monitored track circuits in the quarantined area are occupied sequentially. In order to determine the proper sequence where multiple paths to or from the same point are possible (i.e., the adjacent track conditioned by switch position), the SMO software monitors the state of the switch points.

The SMO application uses fail safe techniques. However, the SMO application logic will recover from any failure resulting in a reset of the example Microlok® II CPU 28 with any and all quarantines removed, and relying solely on the vitality of the track circuit system. During a relatively short period (e.g., 30 seconds) following the startup of the vital processor 22, out of sequence track occupancy or un-occupancy do not trigger out of sequence alarms.

The SMO system 20 does not detect the following track circuit anomalies: (1) any out of sequence event with the vital processor 22 powered OFF, or in startup; (2) any out of sequence event in a predetermined period following the startup of the vital processor 22; (3) any out of sequence event with trains maintaining less than one track circuit separation; (4) any out of sequence event resulting from multiple adjacent track circuits losing shunt; or (5) any out of sequence event resulting from a track circuit losing shunt and the track circuits in advance failing in sequence.

The SMO system 20 operating in normal (not bypass) mode delays the response of the overall system by an amount of time employed by the SMO system 20 to recognize an input change and react by changing the state of a corresponding output. For change of state from less restrictive to more restrictive, this can add, for example and without limitation, about 500 mS. For changes of state from more restrictive to less restrictive, this can add, for example and without limitation, about 850 mS.

The SMO system 20 provides the following functions: (1) monitors occupancy of all track circuits; (2) minimizes false quarantines by allowing for intermittent safe (or right-side) failures of equipment causing intermittent false track circuit occupancy (the intermittent safe failure of a track circuit is considered to be a track circuit "bobbling" or "bobbing" when the track circuit momentarily indicates track occupied while unoccupied); (3) quarantines three track circuits for each out of sequence event; and (4) operates in normal and reverse running through all allowable routes.

FIGS. 5A1-5A2 form a flowchart of the logic 40 for the sequential monitoring overlay system 20. The logic includes two inputs of the "track circuit becomes occupied" 42 and the "track circuit becomes unoccupied" 44 from the track circuit product. Four outputs include the "drop track output" 46 to cause the state of the track circuit output to change from logical one to logical zero and result in a parallel output of the vital processor 22 associated with the track circuit to change state from energized to de-energized, "drop adjacent track outputs" 48 to cause the state of the adjacent track circuit outputs to change from logical one to logical zero and result in parallel outputs associated with the adjacent track circuits to change state from energized to de-energized, "pick adjacent track outputs if unoccupied" 50 to cause the state of the adjacent track circuit outputs to change from logical zero to logical one and result in the parallel outputs associated with the adjacent track circuits to change state from de-energized to energized, and "pick track output" 52 to cause the state of the track circuit output to change from logical zero to logical one and result in a parallel output associated with the track circuit to change state from de-energized to energized.

Figure 5B:
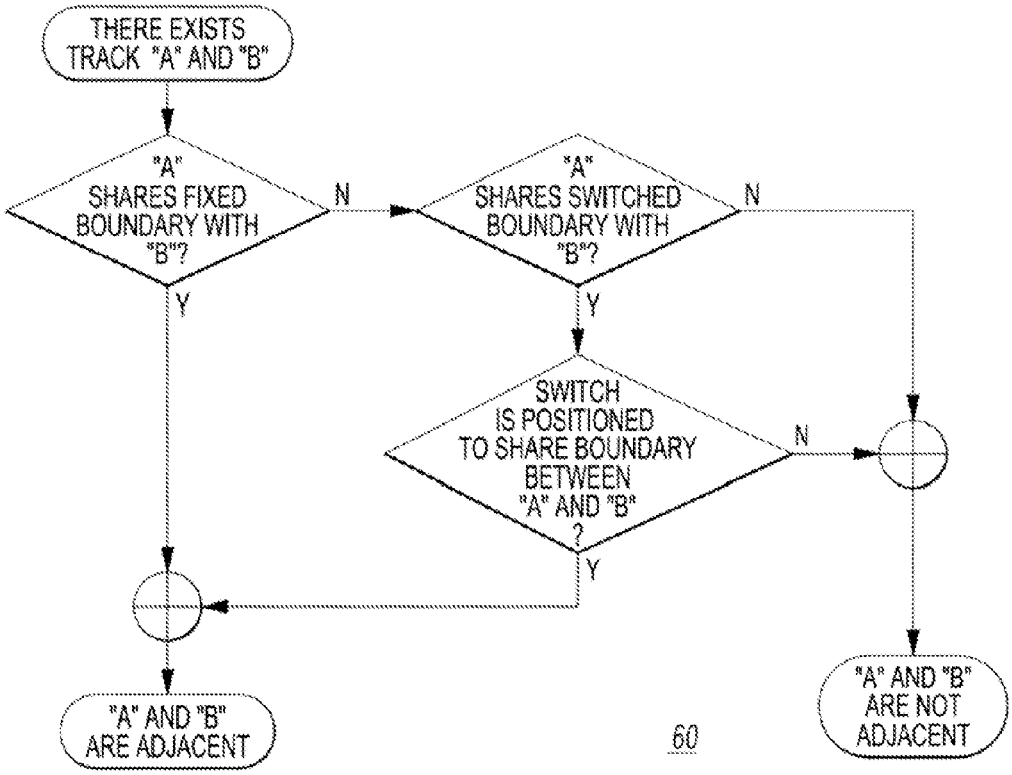

FIG. 5B is a flowchart of the logic 60 for adjacent track determination. For any three track circuit, A, B and C, with A and B adjacent, and B and C adjacent, proper operation of the track circuit devices can be monitored and certain anomalies resolved using the disclosed sequential monitoring overlay system 20. Adjacent track circuits are determined according to the adjacent track determination logic, which determines whether tracks "A" and "B' are either adjacent or not adjacent.

Figure 5D:
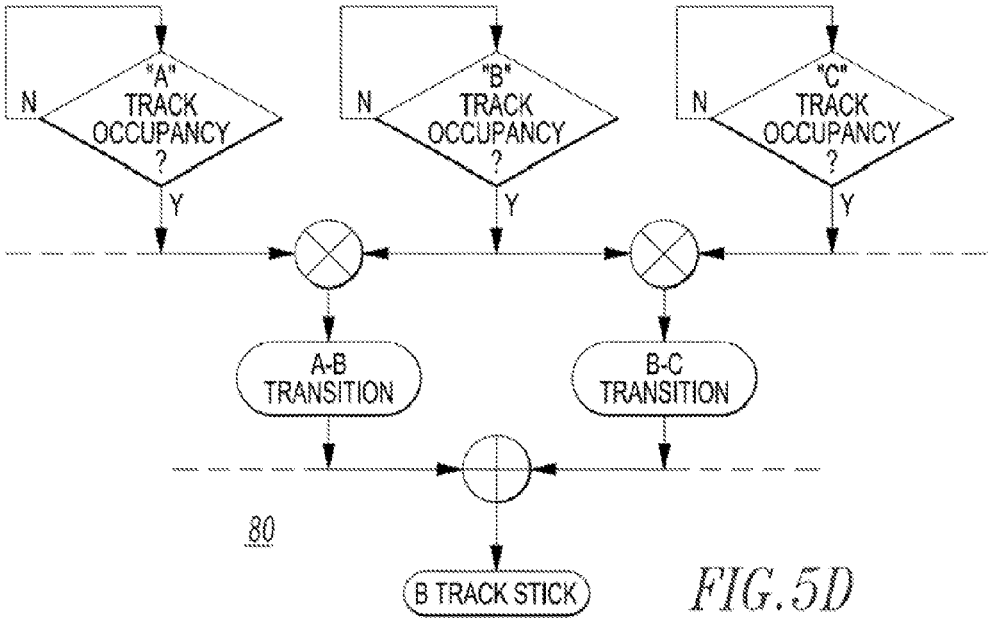
Figure 5C:
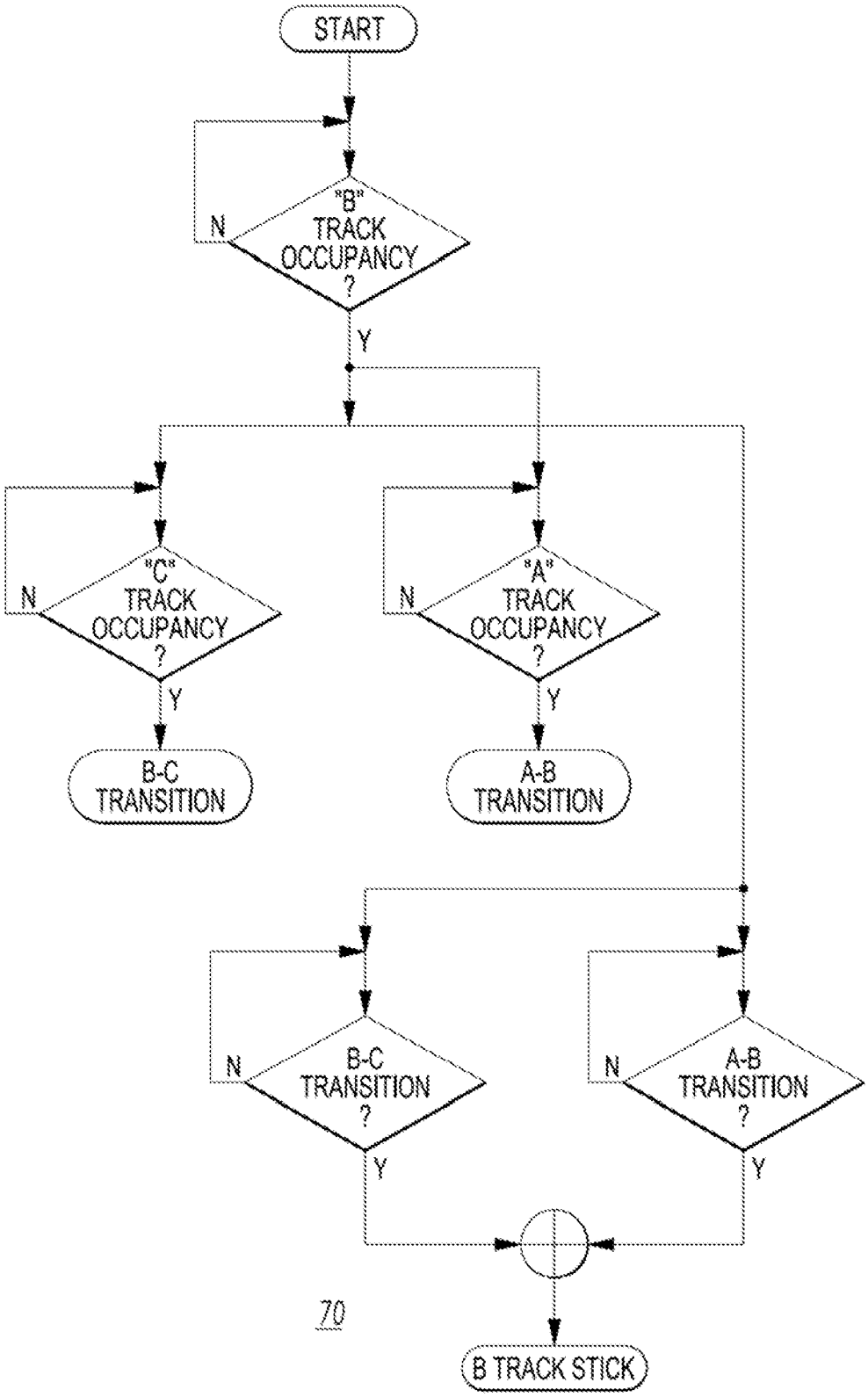

FIG. 5C is a flowchart of the logic 70 for track shunt to track stick. Iterations of this generic flowchart exist for each monitored track circuit, and adjacent iterations interconnect where shown with dashed lines. The entry point for this flowchart is the SMO system 20 operating in normal mode (i.e., not power off, bypass, or startup). The vital processor 22 determines whether two track circuits are occupied (e.g., "A-B transition"), and when a track circuit has become occupied in proper sequence (A Track Stick, B Track Stick or C Track Stick).

FIG. 5D is a flowchart of the logic 80 for track release to track stick release and disrupted sequence alarm release. The entry point for this flowchart is the SMO system 20 operating in normal mode (i.e., not power off, bypass, or startup). If the B track is unoccupied and the B track stick is set, then the ABC D.S. alarm is set. If, however, the C track stick is set or the A track stick is set, then there is a proper release of the B track circuit, and a proper release of the ABC D.S. alarm.

Figure 5E:
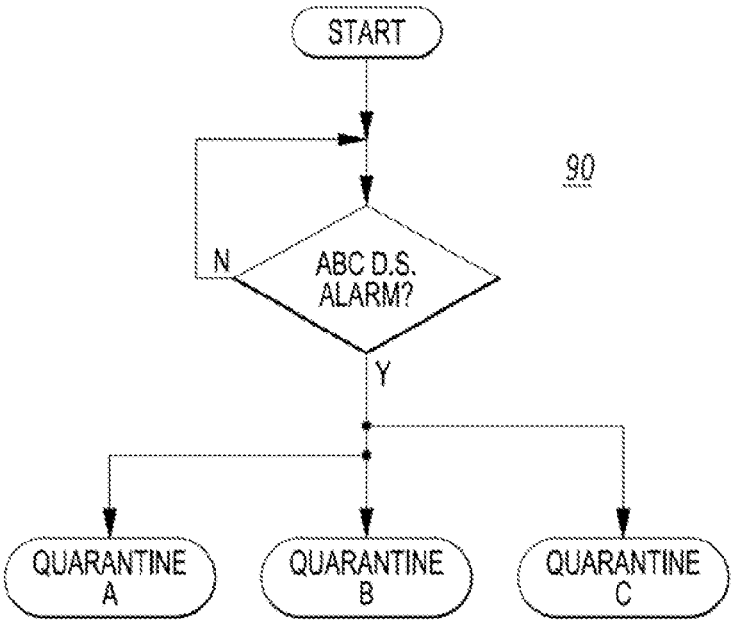

FIG. 5E is a flowchart of the logic 90 for alarm to quarantine. The entry point for this flowchart is the SMO system 20 operating in normal mode (i.e., not power off, bypass, or startup). The vital processor 22 determines whether track circuits are quarantined (Quarantine A, Quarantine B and Quarantine C) if the ABC D.S. alarm is set.

Figure 5F:
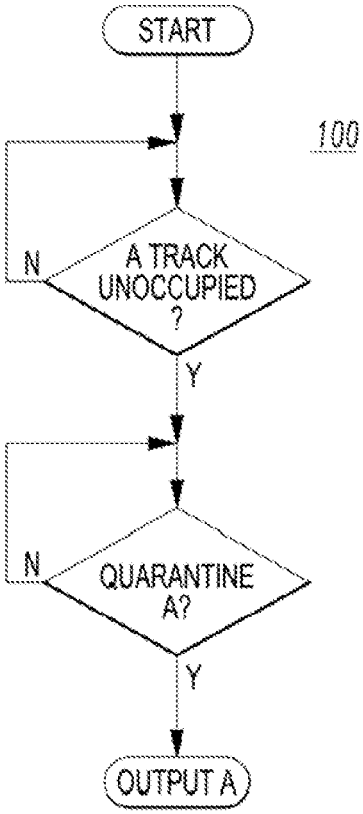

FIG. 5F is a flowchart of the logic 100 for output. The entry point for this flowchart is the SMO system 20 operating in normal mode (i.e., not power off, bypass, or startup). The vital processor 22 determines an output (Output A) for a track circuit (A) where the track circuit (A) is unoccupied and is quarantined (Quarantine A) as a result of the ABC D.S. alarm (FIG. 5D). It is understood that there is suitable logic for every monitored track circuit that will match the flowchart for "Output A". Inputted track indications are combined with the ABC D.S. alarm and outputted as a track indication essentially equivalent to the original track indication to the existing system. To the existing system, there is no difference between a quarantined track and an occupied track. Hence, the safety measures will treat a disrupted sequence related quarantined track circuit as a train.

The disclosed SMO logic 40, 60, 70, 80, 90, 100 provides the following functions: (1) monitors the state (occupied or unoccupied) of each track circuit; (2) determines proper sequence by occupancy of the track circuits along a possible route (not necessarily an interlocking route, but simply a valid train movement) in order with proper transitions between track circuits; (3) determines proper transitions as both track circuits occupied simultaneously; (4) detects track circuit loss of shunt without transition to an adjacent track circuit as an out of sequence event in the formerly occupied track circuit; (5) applies a quarantine to the track circuit with an out of sequence event, and all immediately adjacent (and accessible by switch position) track circuits; (6) passes through the track occupancy information directly from input to output unless the track circuit is in quarantine; (7) inhibits the pass through of the track occupancy information when the track circuit is in quarantine; (8) removes the quarantine upon completion of a proper sequence through the quarantined area (properly transitioning into and/or out of the quarantined area in any direction); (9) accepts inputs of switch point position; (10) dynamically determines adjacent track circuits using switch position correspondence; (11) is fail-safe, with the exception of the treatment of system startup and bypass; and (12) upon startup, accepts all track circuit occupancies as in sequence.

EXAMPLE

The disclosed concept can be employed as an overlay. Furthermore, the overlay can be employed for nearly any system using track circuits for train detection and logic (e.g., without limitation, relay; microprocessor) to determine the appropriate signal or switch conditions (e.g., without limitation, aspects; movements; locks; cab signals). This replaces the interface between two subsystems (i.e., a vital interlocking logic system and a track circuit train detection system), and autonomously performs suitable logic to identify any situation where the interface should be interrupted due to subsystem anomalies.

The disclosed concept effectively and efficiently monitors the proper operation of track circuits and disallows potentially invalid track circuit indications. The disclosed concept has several advantages over known prior proposals: (1) it can be applied as an overlay; (2) it not only monitors proper track circuit sequence, but also directly affects vital circuits, such as cab signaling and train-stop operation; (3) it does not require any changes to existing interlocking logic; and (4) it does not require any changes to existing track circuit equipment.

The disclosed concept increases the reliability of track circuit unoccupied indication, provides a compact design with minimal components, and employs minimal points of interface to existing systems.

The disclosed concept can employ any suitable vital or failsafe processor system allowing the use of suitable input/output circuits.

The disclosed concept can employ any suitable vital or failsafe relays.

The disclosed concept can employ any suitable interface to any suitable track circuit providing suitable discrete outputs or suitable serial outputs compatible with the vital or failsafe processor system.

The disclosed concept can employ any suitable interface to the input circuits of the vital or failsafe processor system.

The disclosed concept can employ any suitable interface to the output circuits or relays of the vital or failsafe processor system.

The disclosed concept can be applied as an overlay to an existing application or embedded into a new or "green field" application.

The disclosed concept can be employed with or without the disclosed "bypass mode" or "bypass relay".

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A method of sequentially monitoring a plurality of track circuits for an interlocking logic system and a track circuit system including said track circuits, each of said track circuits having a state, said method comprising:

interfacing between said interlocking logic system and said track circuit system;

normally passing inputs from said track circuit system to outputs to said interlocking logic system;

monitoring the state of each of said track circuits by a processor;

validating a sequence of state changes of said track circuits by said processor;

interrupting and correcting invalid track circuit state indications by said processor between said track circuit system and said interlocking logic system; and applying a quarantine by said processor to a minimum of three of said track circuits in a quarantined area when an out of sequence event is detected by said processor, wherein said out of sequence event is caused by one of said three of said track circuits changing state from occupied to unoccupied without an adjacent one of said three of said track circuits having an occupied state, wherein said quarantine forces a state of said one said three of said track circuits as received by said interlocking logic system to be occupied, thereby inhibiting use of an unoccupied track circuit in the quarantined area.

2. The method of claim 1 further comprising:

responsive to said quarantine, interfering by said processor with pass through logic for said minimum of three of said track circuits in said quarantine; and forcing and maintaining an OFF state of corresponding outputs to said interlocking logic system.

3. The method of claim 1 further comprising:

for each of said track circuits, passing track occupancy information directly from a corresponding one of said inputs from said track circuit system to a corresponding one of said outputs to said interlocking logic system unless a corresponding one of said track circuits is in said quarantine.

4. The method of claim 3 further comprising:

inhibiting passing said track occupancy information when the corresponding one of said track circuits is in said quarantine; and removing said quarantine upon completion of a proper sequence through the quarantined area upon proper transitioning into and/or out of the quarantined area in any direction.

5. The method of claim 3 further comprising:

maintaining said quarantine until all of said track circuits in the quarantined area are occupied sequentially.

6. The method of claim 3 further comprising:

for said each of said track circuits, requiring that any adjacent track circuit be occupied in order to trigger said quarantine.

7. The method of claim 1 further comprising:

monitoring of transitions between said track circuits when two adjacent track circuits are occupied simultaneously.

8. The method of claim 1 further comprising:

passing the inputs from said track circuit system to the outputs to said interlocking logic system when in a bypass mode.

9. The method of claim 1 further comprising:

employing as said processor a vital processor.

10. The method of claim 1 further comprising:

applying said quarantine to one of said track circuits with the out of sequence event and to all immediately adjacent track circuits.

11. A sequential monitoring system for an interlocking logic system and a track circuit system including a plurality of track circuits, each of said track circuits having a state, said sequential monitoring system comprising:

an interface between said interlocking logic system and said track circuit system; and a processor structured to monitor the state of each of said track circuits, validate a sequence of state changes of said track circuits, and interrupt and correct invalid track circuit state indications between said track circuit system and said interlocking logic system, wherein said interface normally passes inputs from said track circuit system to outputs to said interlocking logic system, and wherein when an out of sequence event is detected by said processor, said processor applies a quarantine to a minimum of three of said track circuits in a quarantined area, wherein said out of sequence event is caused by one of said three of said track circuits changing state from occupied to unoccupied without an adjacent one of said three of said track circuits having an occupied state, wherein said quarantine forces a state of said one said three of said track circuits as received by said interlocking logic system to be occupied, thereby inhibiting use of an unoccupied track circuit in the quarantined area.

12. The sequential monitoring system of claim 11 wherein said quarantine causes said processor to interfere with pass through logic of said interface for said minimum of three of said track circuits in said quarantine, thereby effectively forcing and maintaining an OFF state of corresponding outputs to said interlocking logic system.

13. The sequential monitoring system of claim 11 wherein for each of said track circuits said interface is structured to pass track occupancy information directly from a corresponding one of said inputs from said track circuit system to a corresponding one of said outputs to said interlocking logic system unless a corresponding one of said track circuits is in said quarantine.

14. The sequential monitoring system of claim 13 wherein said processor is further structured to inhibit said interface from passing said track occupancy information when the corresponding one of said track circuits is in said quarantine, and to remove said quarantine upon completion of a proper sequence through the quarantined area upon proper transitioning into and/or out of the quarantined area in any direction.

15. The sequential monitoring system of claim 13 wherein said processor is further structured to maintain said quarantine until all of said track circuits in the quarantined area are occupied sequentially.

16. A sequential monitoring overlay system for an interlocking logic system and a track circuit system including a plurality of track circuits, each of said track circuits having a state, said sequential monitoring overlay system comprising:

an overlay interface between said interlocking logic system and said track circuit system; and a processor structured to monitor the state of each of said track circuits, validate a sequence of state changes of said track circuits, and interrupt and correct invalid track circuit state indications between said track circuit system and said interlocking logic system, wherein said interface normally passes inputs from said track circuit system to outputs to said interlocking logic system, and wherein when an out of sequence event is detected by said processor, said processor applies a quarantine to a minimum of three of said track circuits in a quarantined area, wherein said out of sequence event is caused by one of said three of said track circuits changing state from occupied to unoccupied without an adjacent one of said three of said track circuits having an occupied state, wherein said quarantine forces a state of said one said three of said track circuits as received by said interlocking logic system to be occupied, thereby inhibiting use of an unoccupied track circuit in the quarantined area.

17. The sequential monitoring overlay system of claim 16 wherein said quarantine causes said processor to interfere with pass through logic of said interface for said minimum of three of said track circuits in said quarantine, thereby effectively forcing and maintaining an OFF state of corresponding outputs to said interlocking logic system.

18. The sequential monitoring overlay system of claim 16 wherein for each of said track circuits said interface is structured to pass track occupancy information directly from a corresponding one of said inputs from said track circuit system to a corresponding one of said outputs to said interlocking logic system unless a corresponding one of said track circuits is in said quarantine.

19. The sequential monitoring overlay system of claim 18 wherein said processor is further structured to inhibit said interface from passing said track occupancy information when the corresponding one of said track circuits is in said quarantine, and to remove said quarantine upon completion of a proper sequence through the quarantined area upon proper transitioning into and/or out of the quarantined area in any direction.

20. The sequential monitoring overlay system of claim 18 wherein said processor is further structured to maintain said quarantine until all of said track circuits in the quarantined area are occupied sequentially.

* * * * *